United States Patent [19]

Grimstad

[11] 4,433,446

[45] Feb. 28, 1984

[54] FLUSH VALVE ATTACHMENT SYSTEM

[75] Inventor: Ronald N. Grimstad, Sheboygan, Wis.

[73] Assignee: Kohler Co., Kohler, Wis.

[21] Appl. No.: 461,437

[22] Filed: Jan. 27, 1983

[51] Int. Cl.[3] ..... E03D 1/34

[52] U.S. Cl. ..... 4/378; 4/329; 4/392; 4/393; 4/400

[58] Field of Search ..... 4/252 R, 345, 324, 329, 4/325, 326, 378, 382, 383, 390, 392, 393, 400, 398, 399, 344, 419, 425, 417, 295

[56] References Cited

U.S. PATENT DOCUMENTS

| | | | |
|---|---|---|---|
| 240,833 | 5/1881 | Martin et al. | 239/559 |
| 2,096,306 | 10/1937 | Pieslak | 4/344 |
| 2,096,307 | 10/1937 | Pieslak | 4/417 |
| 2,756,078 | 7/1956 | Klingler | 4/252 R |
| 2,773,268 | 12/1956 | Hurko et al. | 4/393 X |
| 2,915,762 | 12/1959 | Kivella | 4/295 |
| 3,368,224 | 2/1968 | Ament | 4/393 |
| 4,000,526 | 1/1977 | Biela et al. | 4/325 |
| 4,067,074 | 1/1978 | Harrison | 4/324 |
| 4,145,772 | 3/1979 | Whitney et al. | 4/329 |
| 4,365,365 | 12/1982 | Antunez | 4/392 |

OTHER PUBLICATIONS

P. 111 of the "Kohler Replacement Parts" brochure dated Aug. 1981, showing the K-9354 flush valve.

Pp. 105 and 109 of "Kohler Replacement Pats" brochure, dated Aug. 1981, showing the K-9242 and K-9366 flush valves.

*Primary Examiner*—Henry K. Artis

*Attorney, Agent, or Firm*—Quarles & Brady

[57] ABSTRACT

A flush valve connectable to a wall of a toilet tank is disclosed. In one embodiment, there is a non-circular outlet formed in the bottom wall of the tank. There is also a resilient seal bearing against an upper surface of the bottom wall, the seal surrounding the outlet and having a central bore aligned therewith. A flush valve is provided having a housing that extends through the seal bore and outlet. The housing also has an outwardly extending flange above the seal to trap the seal against the bottom wall, and a radially outwardly extending projection below the bottom wall. The housing is rotatable between a first position in which the projection can pass vertically through the outlet, and a second position where the projection can catch under the bottom wall. In another embodiment, there is a stop member formed on the outside of the housing below the resilient seal and above the projection, the stop member being suitable to interact with the periphery of the outlet to limit rotation of the housing relative to the outlet.

9 Claims, 7 Drawing Figures

FIG.2
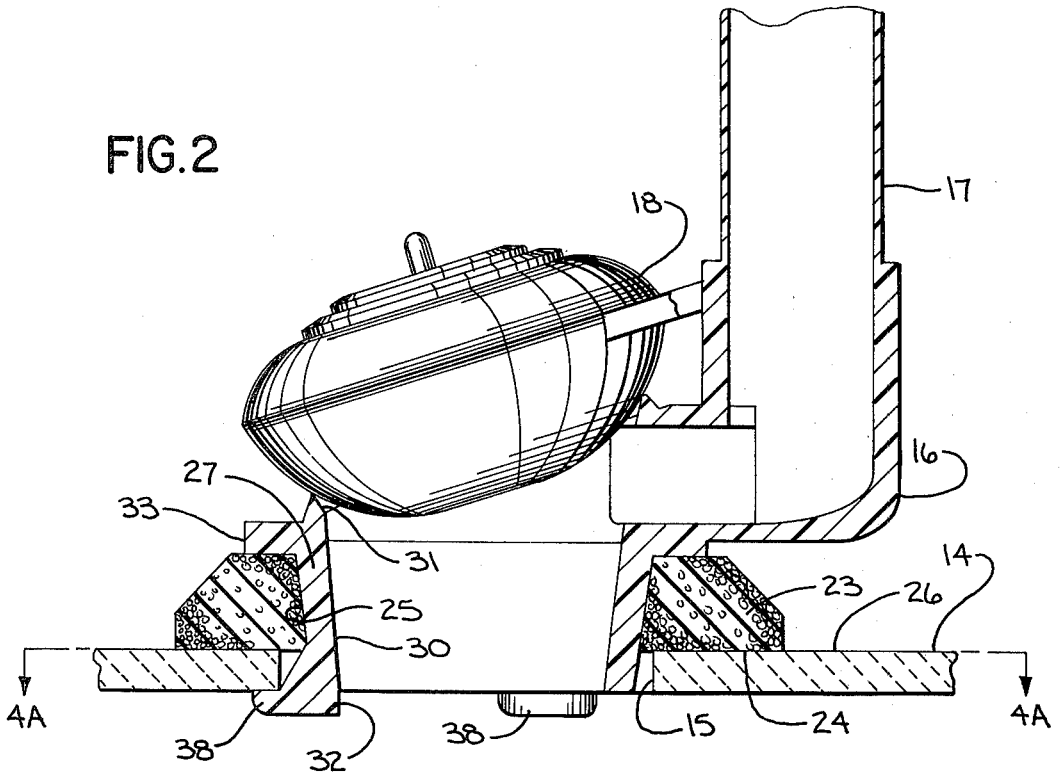
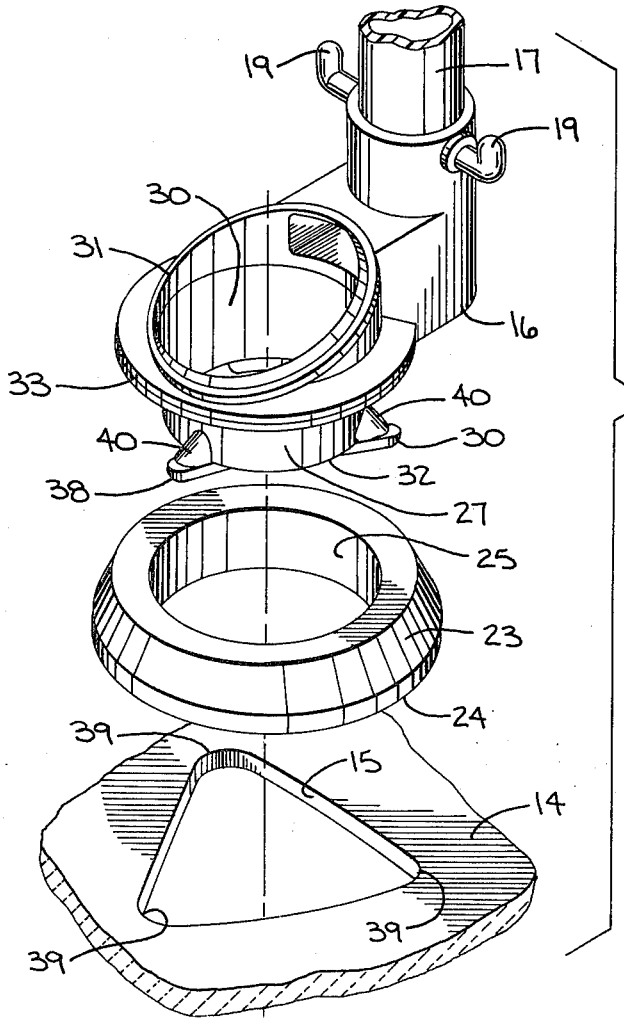
FIG.3

FLUSH VALVE ATTACHMENT SYSTEM

BACKGROUND OF THE INVENTION

A. Field of the Invention

The present invention relates to flush valves that control the outflow of water from a toilet tank. It is especially useful in connection with "one piece" toilets that are constructed so that there is no easy way to reach the underside of the bottom wall of the tank after the toilet has been manufactured.

B. Description of the Art

A well-known type of toilet is one in which the water storage tank and toilet bowl are formed in two separate pieces. Such toilets often have a washer placed around an outlet formed in the bottom of the tank, and a valve housing mounted on the washer and through the washer and outlet. To insure that the housing is fixed in this position, the housing is usually formed with a threaded lower end that extends below the tank bottom wall. A nut is provided which is suitable to be screwed onto these threads (from below the tank wall), so that the nut abuts against the underside of the tank bottom wall. While this flush valve assembly has proved generally satisfactory for "two piece" toilets, the plumbing industry is always interested in ways to further reduce the amount of time required for installation.

Another type of known toilet is the "one piece" toilet. For many one piece toilets, the underside of the tank bottom wall is not accessible. This is because a channel from the tank to the toilet bowl and/or a toilet siphon leg is cast directly underneath the tank.

For such toilets, it is very difficult to attach a conventional flush valve to the "blind hole" at the bottom of the tank. (When there is no easy way to reach the underside of the tank bottom wall, it is very difficult to position a nut under the bottom wall, and then thread it onto an end of the valve housing which is below the tank wall.)

The plumbing industry has therefore attempted to develop flush valve attachment systems which are more suitable for blind outlet holes. Such prior art assemblies have required the use of complicated tools, web structures in the path of flow, and/or the use of glues or soldering. These assemblies are not satisfactory because in order to maximize the cleaning effect of the water, the flush valve should not interfere with the flow through an open outlet. Further, the cost of production and installation of these assemblies is high. Also, assemblies of this type often cannot be installed by consumers who do not have expertise in the plumbing field.

SUMMARY OF THE INVENTION

The present invention resides in a flush valve assembly connectable to the wall of a toilet tank. In one embodiment, there is a non-circular outlet formed in the wall of the tank, and a resilient seal bearing against an interior side of the wall. The seal surrounds the outlet, and has a central bore aligned therewith.

There is also a flush valve having a housing that extends through the seal bore and outlet, the housing having a radially outwardly extending flange inward of the seal to trap the seal against the wall, and a radially outwardly extending projection on the exterior side of the wall. The housing is rotatable between a first position in which the projection can pass through the outlet, and a second position where the projection can catch on the exterior side of the wall.

In another aspect of the invention, there is provided a flush valve assembly connectable to a wall of a toilet tank, the wall having a non-circular outlet formed therein. The assembly comprises a resilient seal which is positionable against an interior side of the wall such that the seal surrounds the outlet. A central bore of the seal is then alignable with the outlet.

There is also provided a flush valve having a housing positionable in the seal bore and outlet (when the seal is so positioned against the wall). This housing has a flange extending radially outwardly inward of the seal to trap the seal against the wall and a projection permanently fixed relative to said housing, and positioned so as to extend radially outwardly from the housing on the exterior side of the tank wall (when the housing and seal are so positioned). The housing is rotatable between a first position in which the projection can pass through the outlet, and a second position where the projection can catch on the exterior side of the wall.

In yet another similar embodiment, there is provided a blind attachment system for connecting a flush valve assembly to an outlet in a toilet tank wall, the flush valve assembly including a housing with an exit portion extending outwardly through the tank outlet. The system comprises a resiliently compressible seal bearing against an inner surface of the tank wall and surrounding the outlet and exit portion, and a radial flange on the housing that bears against an inward surface of the seal to hold it against the tank wall. There is also a radial projection on the exit portion near its outer end and outside the tank wall, and at least one peripheral cutout in the outlet that allows the projection to pass back and forth through the wall when the housing is in one rotational position. The housing is rotatable in the outlet to a second rotational position so that the projection is circumferentially removed from the cutout and bears against the outer surface of the tank wall to hold the flush valve in place thereon.

In an especially preferred embodiment, the projection comprises a plurality of projecting members equally spaced from each other around the outside of the housing, and there are a plurality of stop members formed on the outside of the housing between the resilient seal and each projecting member. These stop members are suitable to interact with the periphery of the outlet to limit rotation of the housing relative to the outlet. They also insure that the housing is properly centered in the outlet.

The present invention allows a user to easily install a flush valve by placing a seal over a tank outlet hole, pushing a specially constructed valve housing through the seal and outlet, turning the housing in the outlet, and releasing the housing. If the procedure is reversed, the flush valve can be removed. The user need not have any direct access to the underside of the tank bottom wall to install or remove the flush valve. Moreover, the underside of the tank wall need not be specially adapted or altered.

The objects of the invention therefore include:

(a) providing a flush valve assembly of the above kind which can be attached to a blind hole formed in the bottom wall of a toilet tank;

(b) providing a flush valve attachment system of the above kind which is relatively inexpensive to produce and install, and can be used by a consumer who has little training in the plumbing arts; and (c) providing a flush valve assembly of the above kind which provides a water tight seal at the bottom of the toilet tank when the valve is closed.

These and still other objects and advantages of the invention will be apparent from the description which follows. In the description, the preferred embodiments of the invention will be described in reference to the accompanying drawings. These embodiments do not represent the full scope of the invention. Rather, the invention may be employed in other embodiments. Reference should therefore be made to the claims to interpret the breadth of the invention.

BRIEF DESCRIPTION OF THE DRAWINGS

FIG. 2 is an enlarged sectional view of a flush valve attachment system embodying the present invention;

FIG. 3 is an exploded perspective view thereof;

DESCRIPTION OF THE PREFERRED EMBODIMENTS

Figure 1:
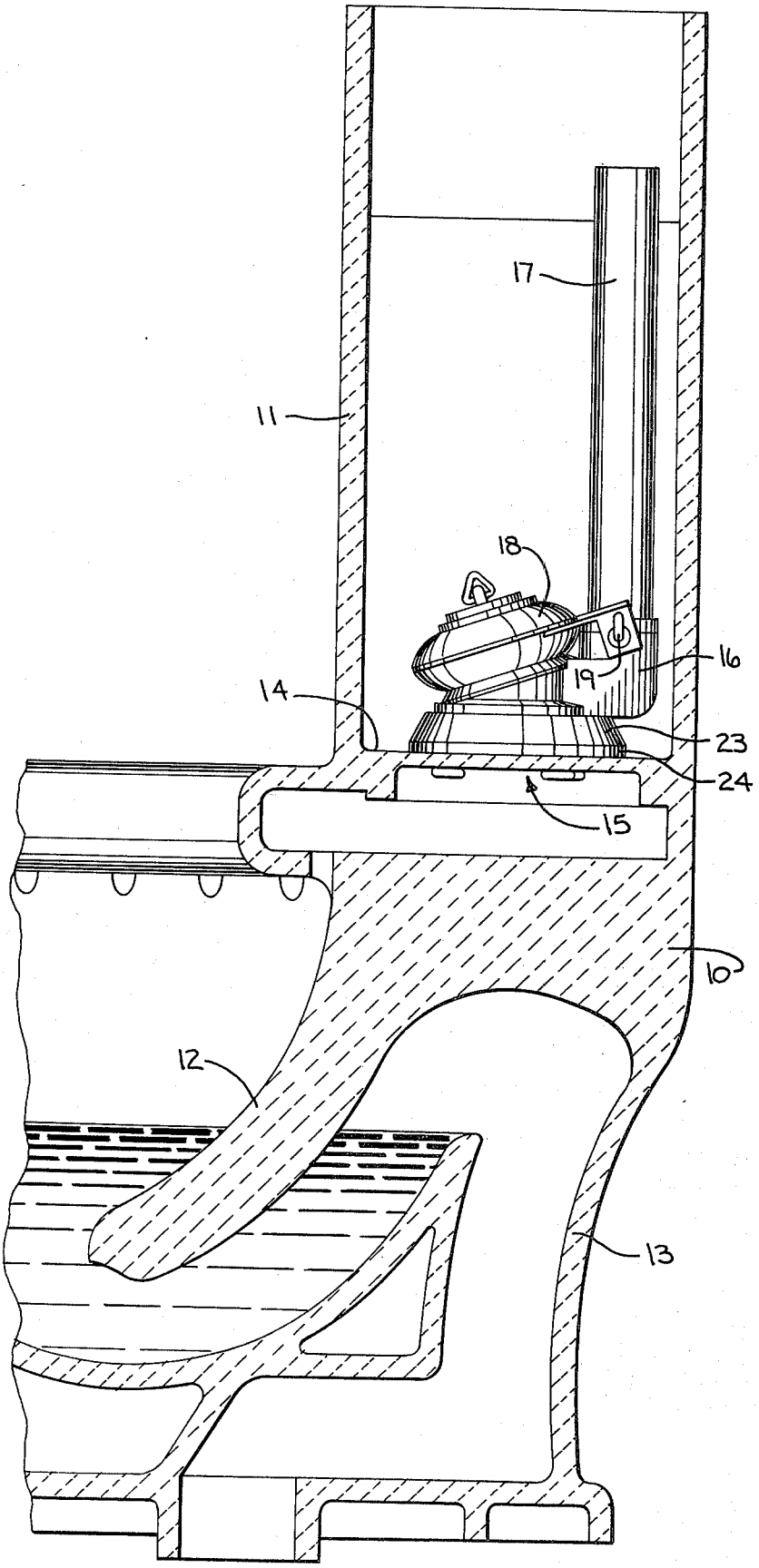
FIG. 1 is a sectional view of a one piece toilet in which has been installed a flush valve assembly embodying the present invention.

Referring now to FIG. 1 of the drawings, a "one piece" toilet 10 consists of a tank portion 11, a bowl portion 12, and a siphon portion 13. As is conventional with such toilets, the tank has a bottom wall 14, and an outlet hole 15 formed in the bottom wall.

A flush valve assembly, referred to generally by numeral 16, includes a conventional overflow tube 17, and a conventional flapper 18 attached onto conventional hooks 19 on the sides of the tube. It should be understood that the flapper 18 is moved onto and off its seat by one of the many known trip mechanisms (not shown). In this regard, when the tank is to be refilled, the flapper will be in the position shown in FIG. 1, and when water is to be let out of the tank, the flapper will be lifted off its seat (usually through use of a chain attached to the top of the flapper).

Referring now to FIGS. 2–6, in accordance with the present invention, a non-circular outlet 15 is formed in the bottom wall 14 of the tank. In the FIG. 3 embodiment, the hole is a contoured triangle. In the FIG. 6 embodiment, the non-circular hole 20 is almost circular, but it has a series of non-circular distortions or cutouts 21. Thus, it should be understood that when the term "non-circular" is used herein, it is intended to cover all shapes other than a simple circular hole.

Resilient, axially compressible seal 23 is also provided. It has a lower sealing surface 24 and a central through bore 25. As shown in FIG. 2, the lower sealing surface 24 bears against the topside or interior surface 26 of the tank bottom wall 14. The seal 23 can then surround and seal the outlet 15 when the bore 25 is aligned over the outlet 15.

The flush valve 16 has a housing portion 27 which extends through the seal bore 25 and outlet 15. This housing has a channel 30 therethrough, a valve seat 31 at the upper end of the channel, and an exit port 32 at the exit portion of the channel 30. Flange 33 extends radially outwardly from the housing 27, above the seal 23, so as to compress and trap the seal 23 against the top of the tank bottom wall 26. It should be understood that the flange need not be a continuous rim. Instead, it could be one or more projections.

Three radially outwardly extending projections 38 extend below the bottom wall 14 on the exterior of the tank, so as to catch under the wall when in the position shown in FIG. 4A, and so as to be able to fit through the outlet 15 when the projections 38 are aligned with the corners 39 of the hole 15. (See e.g. FIG. 6.) In an especially preferred embodiment, these projections are spaced apart from each other an equal distance so as to provide a balanced attachment, and they are permanently fixed relative to said housing, so as to extend radially outward. It should be understood that when the word "permanently" is used in this context, it is meant to indicate that the projection is fixed relative to the housing during installation and during normal use.

Figure 4A:
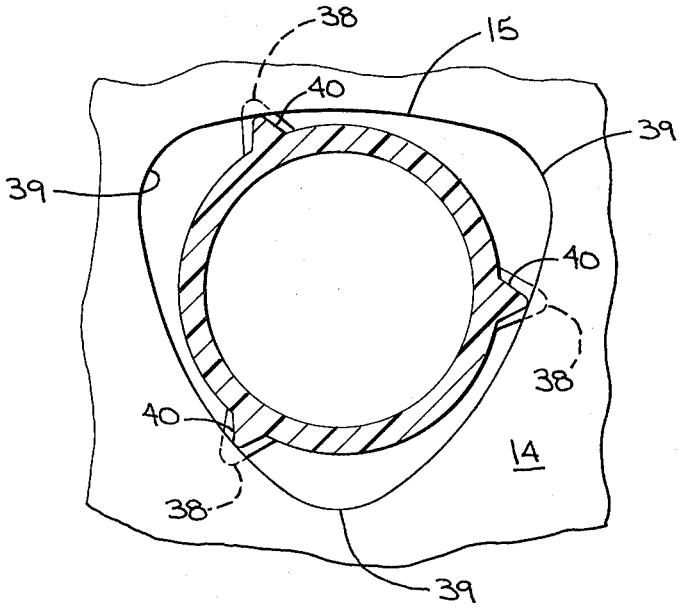
FIG. 4A is a view taken along lines 4A—4A of FIG. 2.
Figure 5:
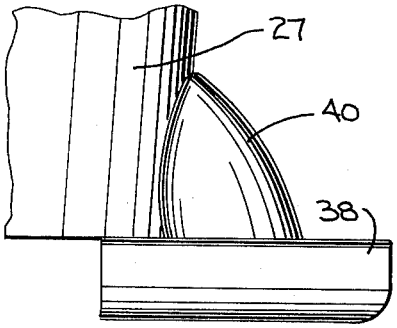
FIG. 5 is a greatly enlarged view of a stop and projection portion of the flush valve of FIG. 2.

Stop members 40 are best shown in FIGS. 3, 4A and 5. They are formed directly over the projections 38, and below the resilient seal 23. They are suitable to interact with the periphery of the outlet 15, so as to limit rotation of the housing 27 relative to the outlet. See FIG. 4A. This prevents an installer from turning the housing too far during installation.

Figure 4B:
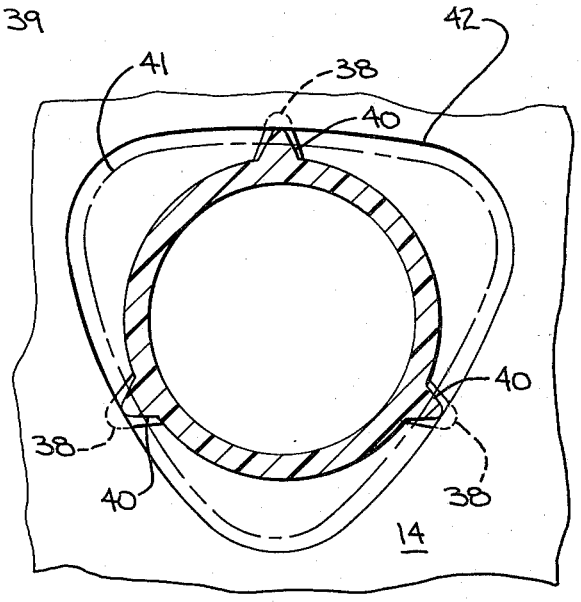
FIG. 4B is a schematic view similar to FIG. 4A, which shows how the flush valve assembly of FIG. 2 can be used with a tank outlet of a different size.
Figure 6:
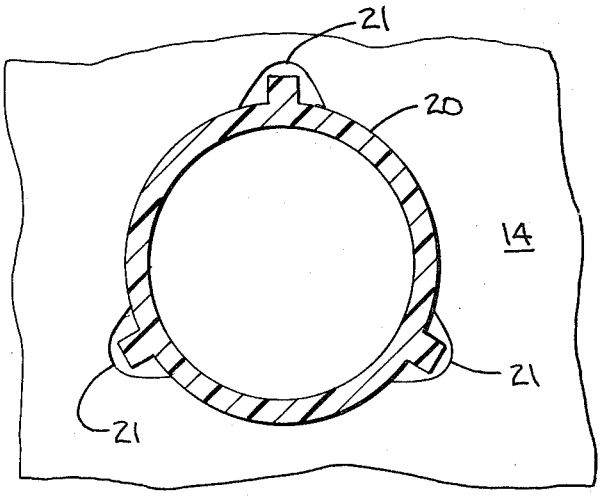
FIG. 6 is a view similar to FIG. 4A, which shows another embodiment of the present invention.

Moreover, the stops 40 allow the flush valve to correct for outlets that are cut slightly large or small. In this regard, line 41 in FIG. 4B represents the size of outlet 15 in FIG. 4A. Line 42 represents a slightly oversized outlet. By comparing FIGS. 4A and 4B, it will be noted that the stops 40 automatically correct for the size difference. They also act to center the flush valve.

To install the flush valve 16, one places the resilient seal 23 over the outlet 15, and inserts the projections 38 through the seal bore 25. By aligning the projections 38 appropriately, the projections can then pass through the widest diameter points 39 of the outlet 15, to the underside of the wall 14.

Using an especially preferred assembly technique, the seal 23 can first be placed around the housing. The projections can then be properly aligned with the outlet 15. From viewing FIG. 2, it can be seen that in this especially preferred form the projections 38 extend farther radially outward from the housing 27 than the through bore 25 of seal 23 does. This prevents the seal 23 from easily falling off of the housing 27 and being lost when the valve 16 is stored or shipped. It also allows easy handling of the assembly when this preferred assembly method is used.

After inserting the projections 38 through the outlet, by pressing down firmly on the housing 27, one can rotate the housing 27 and projections 38 to a point where they are caught under the bottom wall 14, and stops 40 contact the sides of the outlet 15. One then simply releases the housing 27.

The biasing action of the resilient seal 23 will then force the flange 33 upward. This holds projections 38 firmly against the bottom wall 14. Even so, some compression of the seal will continue, so as to prevent water from leaking out of the tank when the flush valve 16 is closed.

It will be appreciated that in addition to the specific embodiments shown, the invention can appear in other embodiments. For example, it is not critical that there be a plurality of projections. One may suffice. Nor is it critical that the assembly be placed on the bottom wall of the tank. A side wall may also prove suitable. Thus, there may be various modifications and changes in embodiments which have been shown which are within the scope of the invention. Such modifications and changes are meant to be within the scope of the invention. As such, the invention is not to be limited by the illustrative description above.

I claim:

1. A flush valve attachment system for connecting a flush valve to a wall of a toilet tank, comprising:

a non-circular outlet formed in the wall of the tank;

a resilient seal bearing against an interior side of the wall, the seal surrounding the outlet and having a central bore aligned therewith;

a flush valve having a housing that extends through the seal bore and outlet, said housing having a radially outwardly extending flange inward of the seal to trap the seal against the wall and a radially outwardly extending projection on the exterior side of the wall; and said housing being rotatable between a first position in which the projection can pass through the outlet, and a second position where the projection can catch on the exterior side of the wall.

2. The flush valve attachment system of claim 1, wherein the projection comprises a plurality of projecting members spaced around the outside of the housing.

3. The flush valve attachment system of claim 2, wherein the projecting members are spaced substantially equal distances apart from each other.

4. The flush valve attachment system of claim 1, wherein there is a stop member formed on the outside of the housing between the resilient seal and the projection, the stop member being suitable to interact with the periphery of the outlet to limit rotation of the housing relative to the outlet.

5. The flush valve attachment system of claim 1, wherein the resilient seal biases the projection tightly against the exterior surface of the tank bottom wall by expanding against the flange.

6. A flush valve assembly connectable to a wall of a toilet tank, said wall having a non-circular outlet formed therein, the assembly comprising:

a resilient seal positionable against an interior side of the wall such that the seal surrounds the outlet, the seal also having a central bore which is alignable with the outlet;

a flush valve having a housing positionable in the seal bore and outlet when the seal is so positioned against the wall, said housing having a flange extending radially outwardly inward of the seal to trap the seal against the wall when the housing and seal are so positioned, and a projection permanently fixed relative to said housing and positioned so as to extend radially outwardly from the housing on the exterior side of the wall when the housing and seal are so positioned; and said housing being rotatable between a first position in which the projection can pass through the outlet and a second position where the projection can catch on the exterior side of the wall.

7. The flush valve assembly of claim 6, wherein the projection extends farther radially outward than the seal bore, when the housing is positioned in the seal bore.

8. A blind attachment system for connecting a flush valve assembly to an outlet in a toilet tank wall, wherein the flush valve assembly includes a housing with an exit portion extending outwardly through the tank outlet, said system comprising:

a resiliently compressible seal bearing against an inner surface of the tank wall and surrounding the outlet and exit portion;

a radial flange on the housing that bears against an inward surface of the seal to hold it against the tank wall;

a radial projection on the exit portion near its outer end and outside the tank wall; and at least one peripheral cutout in the outlet that allows the projection to pass back and forth through the wall when the housing is in one rotational position, the housing being rotatable in the outlet to a second rotational position wherein the projection is circumferentially removed from the cutout and bears against the outer surface of the tank wall to hold the flush valve in place thereon.

9. The blind attachment system of claim 8, wherein the axial spacing between the flange and projection is such that the seal must be axially compressed to move the projection from the first rotation position to the second rotational position.

* * * * *